United States Patent [19]

Sugahara

[11] 4,432,126

[45] Feb. 21, 1984

[54] METHOD OF AND APPARATUS FOR MANUFACTURING SLIDE FASTENER COUPLING ELEMENTS

[75] Inventor: Sadanobu Sugahara, Uozu, Japan

[73] Assignee: Yoshida Kogyo K. K., Tokyo, Japan

[21] Appl. No.: 376,144

[22] Filed: May 7, 1982

[30] Foreign Application Priority Data

Dec. 29, 1981 [JP] Japan ..... 56-215060

[51] Int. Cl.[3] ..... B21D 53/52; A41H 37/06

[52] U.S. Cl. ..... 29/410; 29/766; 29/769

[58] Field of Search ..... 72/336, 337; 29/408, 29/410, 766, 769, 33.2

[56] References Cited

U.S. PATENT DOCUMENTS

| | | | |
|---|---|---|---|
| 2,567,914 | 9/1951 | Wintriss | 29/410 |
| 2,596,888 | 5/1952 | Cohn | 29/410 |
| 2,734,546 | 2/1956 | Firing | 153/1 |
| 2,763,051 | 9/1956 | Firing | 72/336 |
| 3,068,549 | 12/1962 | Firing | 29/34 |
| 3,091,024 | 5/1963 | Poux | 29/410 |
| 3,187,540 | 6/1965 | MacBroom | 72/197 |
| 4,387,495 | 6/1983 | Moroika | 29/408 |
| 4,388,751 | 6/1983 | Fukuroi | 29/410 |

*Primary Examiner*—Howard N. Goldberg
*Assistant Examiner*—Steven Nichols
*Attorney, Agent, or Firm*—Hill, Van Santen, Steadman & Simpson

[57] ABSTRACT

A method of and apparatus for manufacturing coupling elements, suitable for a two-way slide fastener, successively from a rod of metal of a generally Y-shaped cross section having a base, as a prospective coupling head, and a pair of diverging legs. As the rod is fed longitudinally stepwise, it is transversely sliced into a plurality of coupling element blanks, one at a time, on the backward stroke of relative movement of a coacting cutting die and punch. At the end of the backward stroke of the cutting die and punch, a chamfering surface on the cutting punch is forced against the base of the rod to form a chamfered portion thereon so that each sliced coupling element blank has the chamfered base. The chamfered base of each coupling element blank is then formed, by a coacting forming die and punch, into a final coupling head of one coupling element which head has a projection from one face and a socket in the other face at such a position that the chamfered portion is disposed around the socket.

8 Claims, 9 Drawing Figures

METHOD OF AND APPARATUS FOR MANUFACTURING SLIDE FASTENER COUPLING ELEMENTS

BACKGROUND OF THE INVENTION

1. Field of the Invention

The present invention relates to the production of slide fastener stringers, and more particularly to a method of and apparatus for manufacturing slide fastener coupling elements of metal suitable for use with a two-way slide fastener.

2. Prior Art

A two-way slide fastener has a pair of oppositely disposed sliders and hence can be opened from either end. To facilitate smooth movement of the sliders in either direction, it is necessary to chamfer the coupling heads of metallic coupling elements on one face of each coupling head. Such chamfering has been performed by means of a separate, small-sized cutting tool, which not only has a short endurance, but also often causes production of burrs and chips. Further, with the small-sized cutting tool, it is difficult to produce adequate quality of coupling elements.

SUMMARY OF THE INVENTION

It is therefore an object of the invention to provide a method manufacturing high quality of metallic coupling elements suitable for two-way slide fasteners.

Another object of the invention is to provide a method of manufacturing accurate coupling elements, for two-way slide fasteners, enabling an improved rate of production.

Still another object of the invention is to provide an apparatus for carrying out the method described above, which not only requires no additional parts, but also has an improved endurance.

In the present invention, a rod of metal of a generally Y-shaped cross section having a base and a pair of diverging legs is fed stepwise in a longitudinal direction. The rod is transversely sliced into a plurality of coupling element blanks, one on each backward stroke of the relative movement of a coacting cutting die and punch which is movable in timed relation to the stepwise feeding of the rod. At the end of the backward stroke of the cutting die and punch, a chamfering surface on the cutting punch is forced against the base of the rod to form a chamfered portion thereon so that each sliced coupling element blank has the chamfered base. The chamfered base of each coupling element blank is then formed, by a coacting forming die and punch, into a final coupling head of one coupling element which head has a projection from one face and a socket in the other face at such a position that the chamfered portion is disposed around the socket.

Other objects and advantages will appear from the following description of an example of the invention, when considered in connection with the accompanying drawings, and the novel features are particularly pointed out in the appended claims.

BRIEF DESCRIPTION OF THE DRAWINGS

Like reference numerals designate similar parts throughout the several views.

DETAILED DESCRIPTION

Figure 1:
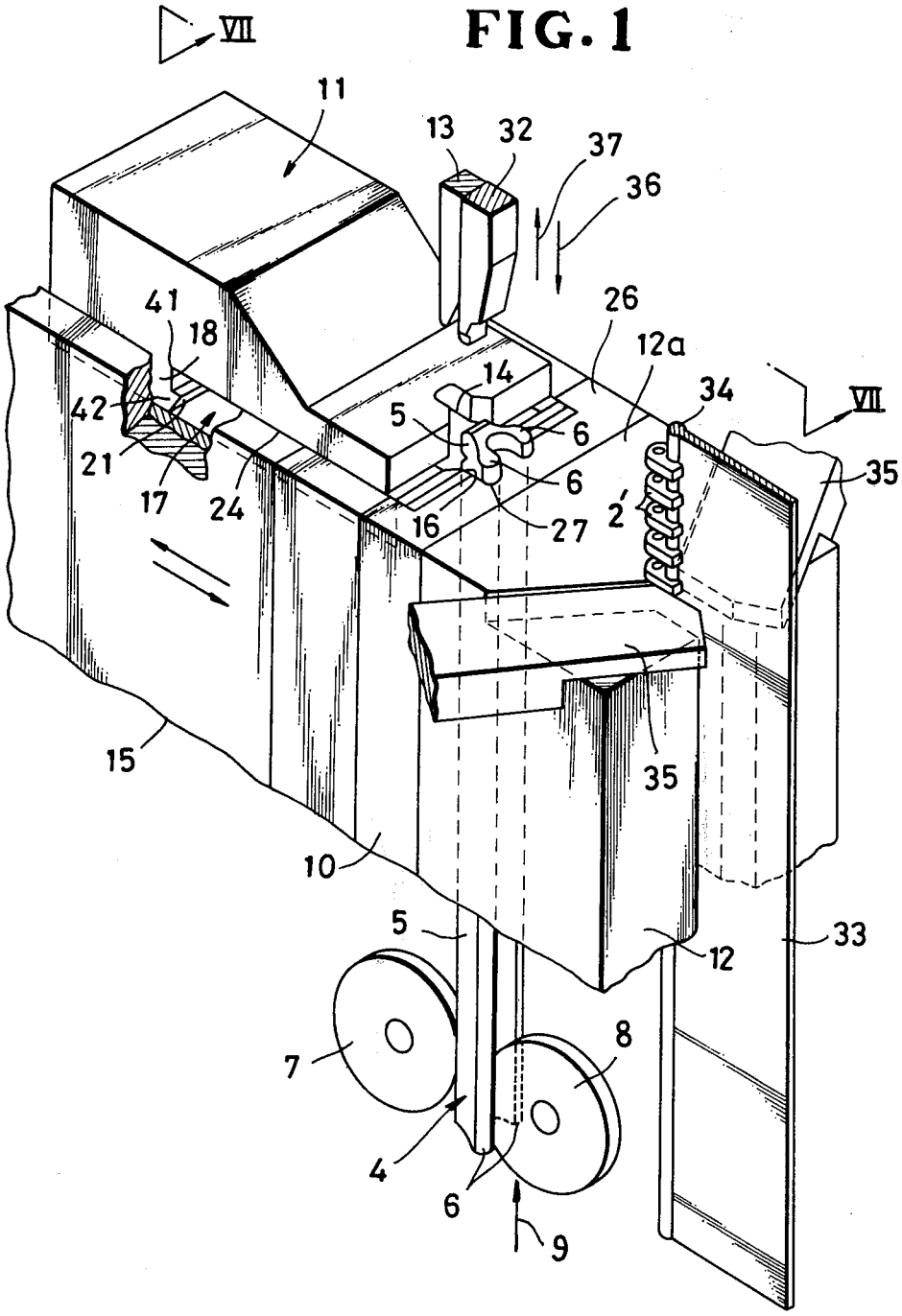
FIG. 1 is a fragmentary perspective view of an apparatus according to a first embodiment of the present invention.

FIG. 1 shows an apparatus 1 for manufacturing coupling elements 2′, for a slide fastener and more particularly for a two-way slide fastener 3 (FIG. 7), from a rod 4 of metal of a generally Y-shaped cross section having a base 5, as a prospective coupling head 5″ (FIGS. 2, 5, 8 and 9), and a pair of legs 6,6 divergently extending from the base 5.

The apparatus 1 generally comprises a pair of rollers 7,8 for feeding the rod 4 stepwise upwardly, i.e. in a longitudinal direction indicated by an arrow 9, in regular steps of a distance h (FIG. 2) equal to the thickness of a single coupling element 2′, a coacting cutting die and punch 10,11 for transversely slicing the rod 4 into a plurality of coupling element blanks 2 (only one shown in FIGS. 3 and 4) in timed relation to the stepwise feeding of the rod 4, and a coacting forming die and punch 12,13 for forming a slice of coupling element blank 2 into a final coupling element 2′.

The cutting punch 11, which is stationary, has at its forward end a cutting edge 14. The cutting die 10, which is carried by a horizontally reciprocating ram 15 at its forward end, has a vertical hole 16 for the passage of the rod 4. The ram 15 has a horizontal channel 17 in which a projection 18 of the cutting punch 11 is slidably received and which leads to the upper end of the hole 16 of the cutting die 10. Thus the cutting die 10 is movable back and forth, in response to the reciprocating movement of the ram 15, across the cutting edge 14 of the cutting punch 11 for transversely slicing the rod 4 into the individual coupling element blanks 2 one on each backward stroke of the ram 15.

Figure 2:
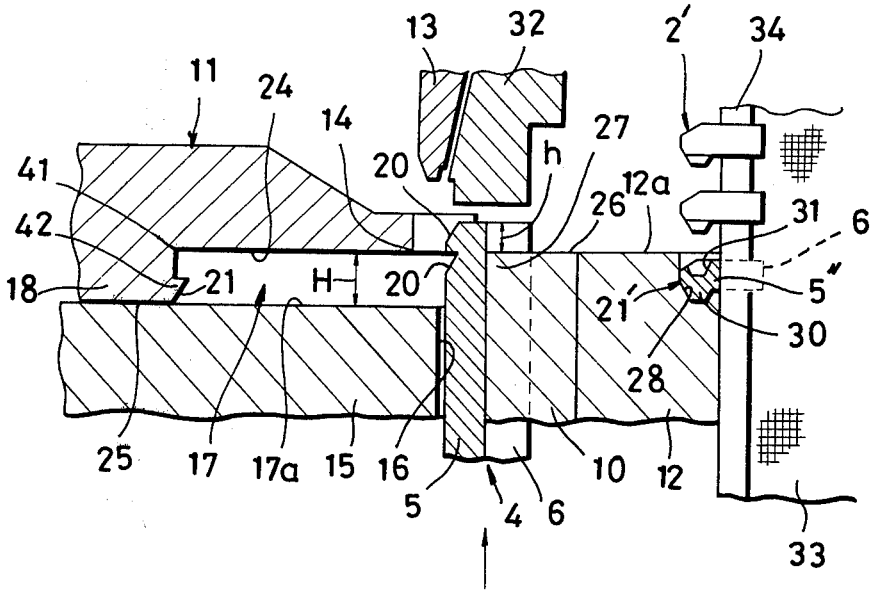
FIG. 2 is a longitudinal cross-sectional view taken along line VII—VII of FIG. 1, showing the parts in a starting position for the manufacture of a coupling element.
Figure 3:
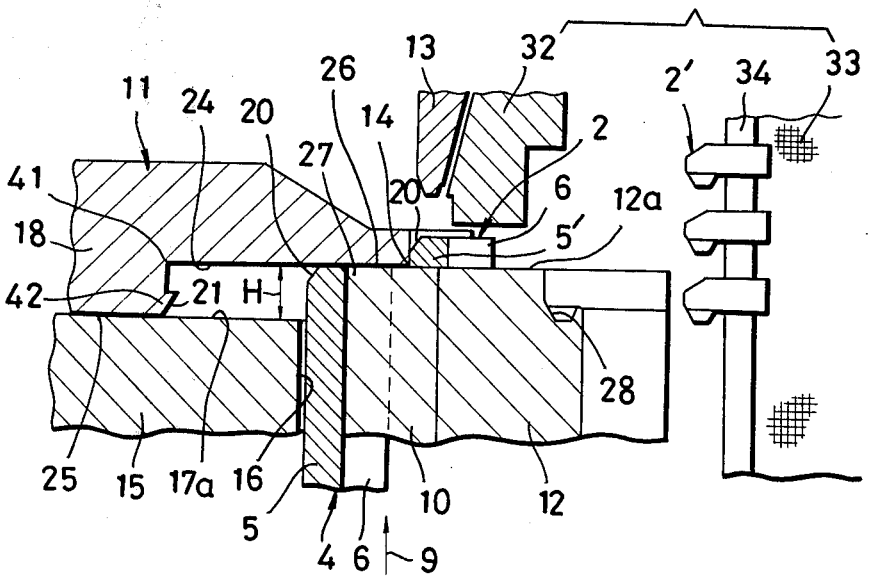
FIGS. 3 through 5 are cross-sectional views similar to FIG. 2, each showing a different stage of the manufacture.
Figure 4:
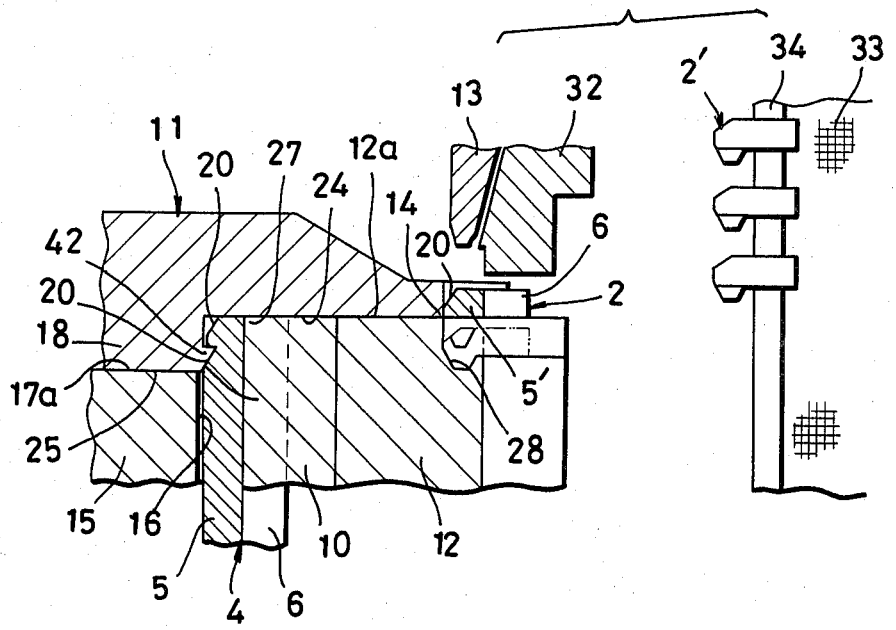

The apparatus 1 also includes a means, disposed on the projection 18 of the cutting punch 11, for forming a chamfered portion 20 on the base 5 of the rod 4 at the end of each backward stroke of the ram 15, so that each coupling element blank 2 has the chamfered base 5′ (FIGS. 3 and 4). The chamfered-portion forming means includes a chamfering surface 21 disposed below a corner 41 (described below) by the distance h (FIG. 2) equal to the thickness of a single coupling element 2′, the corner 41 being defined by the projection 18 and a horizontal surface 24. The chamfering surface 21 comprises a beveled surface of a nose 42 extending forwardly from the projection 18.

The horizontal surface 24 is disposed at a level above a bottom surface 25 of the projection 18 by a distance H (FIG. 2). An upper horizontal surface 26 of the cutting die 10, which includes a cutting edge 27, is disposed at a level above the bed or bottom 17*a* of the channel 17 of the ram 15 by the same distance H. Thus as the projection 18 of the stationary cutting punch 11 slidably engages the bed 17*a* of the channel 17 of the ram 15, the horizontal surface 24 of the cutting punch 11 slidably engages the upper horizontal surface 26 of the cutting die 10, during which time the cutting edges 27,14 of the cutting die and punch 10,11 are moved relatively to each other.

The forming die 12, contiguous to the cutting die 10, is also carried by the ram 15 and is movable, in response to the reciprocating movement of the ram 15, toward and away from the cutting edge 14 of the cutting punch 11 for receiving one coupling element blank 2 in a coupling-head forming recess 28 at the end of each backward stroke of the ram 15.

Figure 5:
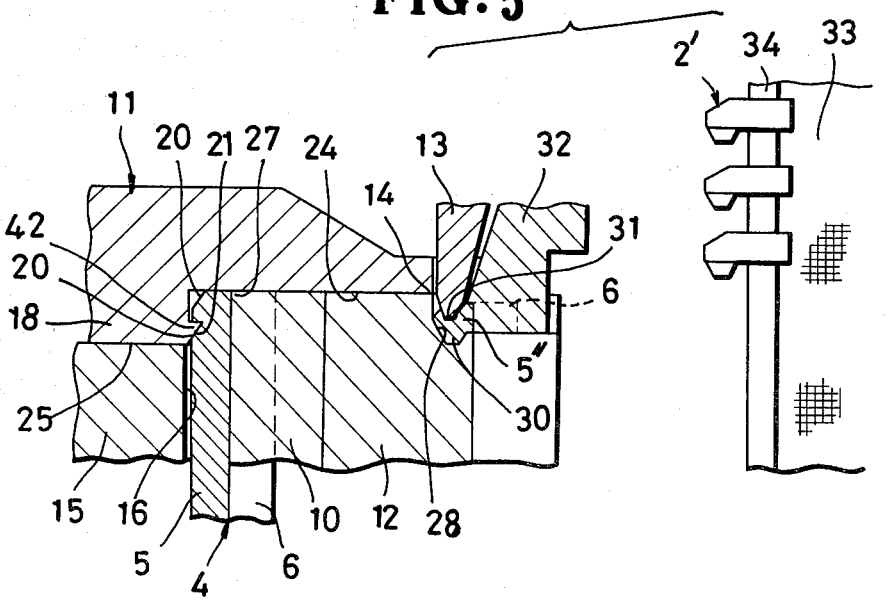

At the end of each backward stroke of the ram 15 (FIGS. 4 and 5), the forming recess 28 is in vertical alignment with the forming punch 13 which is movable vertically toward and away from the recess 23, i.e. in directions indicated by arrows 36,37 (FIG. 1). As the forming punch 13 is lowered to press the coupling element blank 2 at the chamfered base 5', the latter is formed into a final coupling head 5'' (FIGS. 2, 5, 8 and 9) having a projection 30 from the lower face and a coacting socket 31 in the upper face at such a position that the beveled surface 20 is disposed around the socket 31. At that time, the coupling element blank 2 is retained in the recess 28 by a presser 32 lowered together with the forming punch 13. Thus a complete coupling element 2' has been produced (FIGS. 2 and 5).

At the end of each forward stroke of the ram 15 (FIGS. 1 and 2), a freshly completed coupling element 21' is located adjacent to a slide fastener stringer tape 33 with the legs 6,6 disposed astride the beaded tape edge 34. A pair of pressing levers 35,35 (FIG. 1) is moved toward each other to clinch the opposite legs 6,6 about the beaded edge 34 of the tape 33, which is fed upwardly in steps of a predetermined distance equal to the element-to-element pitch.

In operation, when the ram 15 is moved backwardly, i.e. leftwardly in FIG. 2, the cutting die 10 is moved in the same direction to force the rod 4 to move across the cutting edge 14 of the fixed cutting punch 11, whereby the upper end portion of the rod 4 which projects out of the hole 16 is sliced off to produce a coupling element blank 2 (FIG. 3). The rod 4 is fed stepwise upwardly so that it projects from the cutting edge 27 of the cutting die 10 by a length h (FIG. 2) in order that the sliced coupling element blank 2 will have a thickness equal to the length h.

With continued backward movement of the ram, the sliced coupling element 2 slides on the horizontal upper surface 26 of the forming die 12, as shown in FIG. 3, until the coupling head forming recess 28 is vertically aligned with both the sliced coupling element blank 2 and the forming punch 13 (FIG. 4). During that time the rod is moved leftwardy and, at the end of the backward stroke of the ram 15, the rod 4 is forced, at a portion below the freshly cut end, against the nose 42 on the projection 18 of the cutting punch 11. The nose 42 bites into the base 5 of the rod 4. Thus a beveled surface 20 corresponding to the chamfering surface 21 has been formed on the base 5 of the rod 4 so that the next coupling element blank 2 will have the chamfered base 5'. The preceding coupling element blank 2 had been provided at the base 5' with the same chamfered portion 20 in the same manner. The next coupling element blank 2 will have the chamfered portion 20 which had been formed on the previous backward stroke of the ram 15.

The forming punch 13 is lowered to press the coupling element blank 2 at the chamfered base 5' to thereby form the latter into a final coupling head 5'' (FIGS. 2, 5, 8 and 9) having a projection 30 from the lower face and a coacting socket 31 in the upper face at such a position that the beveled surface 20 is disposed around the socket 31. At that time the coupling element blank 2 is retained in the recess 28 by the presser 32 lowered together with the forming punch 13. Thus a complete coupling element 2' has been produced (FIGS. 2 and 5). Then, the forming punch 13 and the presser 32 are retracted upwardly and, at the same time, the ram 15 is moved forwardly from the retracted position (FIGS. 4 and 5) to the advanced position (FIG. 2) in which the opposite legs 6,6 of the coupling element blank 2 in the recess 28 are disposed astride the beaded edge 34 of the stringer tape 33.

Finally, the opposite legs 6,6 of the coupling element blank 2 are clinched by the pair of pressing levers 35,35 about the beaded edge 34 of the tape 33 which is held at rest between intermittent movements thereof.

Figure 7:
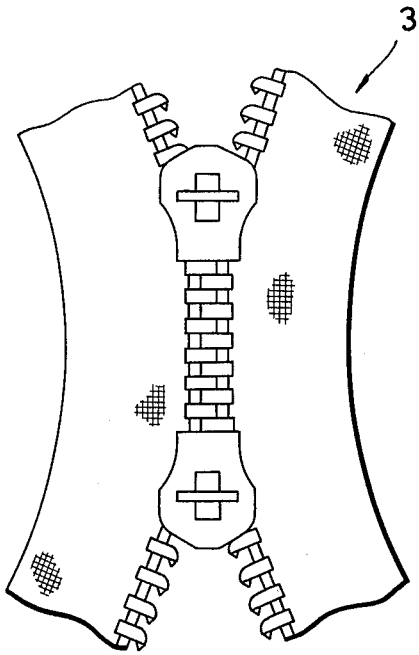
FIG. 7 is a fragmentary plan view of a two-way slide fastener having coupling elements manufactured according to the present invention.
Figure 8:
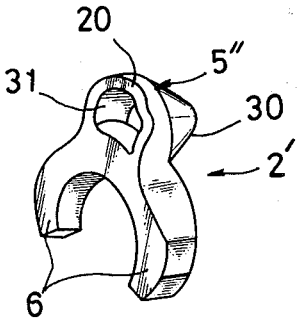
FIGS. 8 and 9 are enlarged perspective views of different kinds of coupling elements manufactured according to the present invention and suitable for use with a two-way slide fastener.
Figure 9:
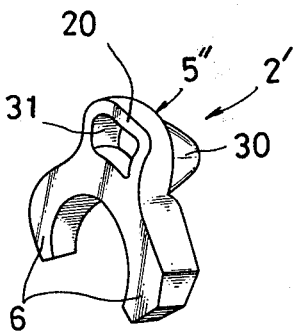

According to the present invention, a chamfered portion is formed on the base of the rod in order that the base of the individual coupling element blank will have such chamfered portion before the formation of a projection and a coacting socket, and for this reason, it is possible to form a chamfered portion accurately and reliably, thus producing high quality coupling elements suitable for a two-way slide fastener (FIG. 7).

Since the slicing step and the placing step and the chamfered-portion forming step are performed in sequence on only a single stroke of relative movement of the cutting die and punch, it is possible to manufacture accurate coupling elements with improved rate of production.

Further, the apparatus 1 is very simple in construction and hence can be obtained from the conventional apparatus by providing the cutting die with the horizontal channel 17 behind the vertical hole and by providing the cutting punch with the chamfering surface 21, which modification requires no complicated machining or added parts.

Figure 6:
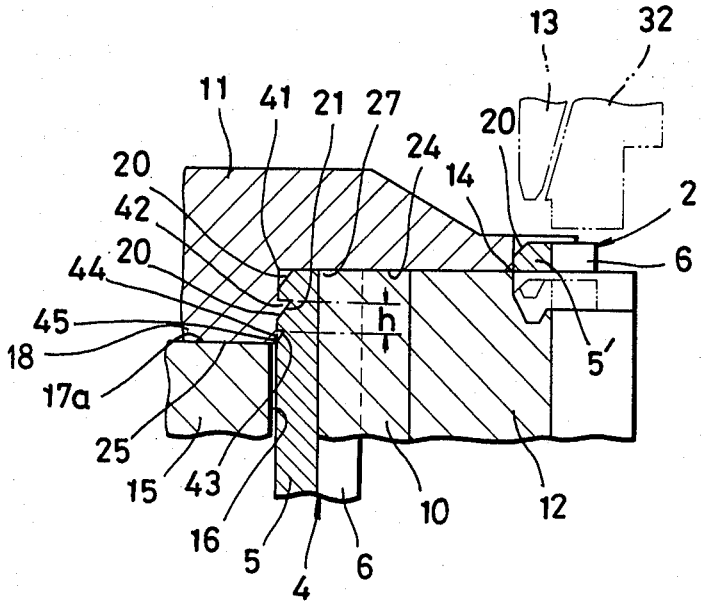
FIG. 6 is a cross-sectional view similar to FIG. 4, but showing a second embodiment, with parts omitted.

FIG. 6 is a fragmentary cross-sectional view showing a second embodiment similar to the embodiment of FIGS. 1 through 5, and the only difference therefrom is that the chamfered-portion forming means further includes an auxiliary chamfering surface 43 disposed below the chamfering surface 21 by a distance h (FIG. 2) equal to the thickness of one coupling element. The auxiliary chamfering surface 43 comprises a beveled surface of a small nose 44. The nose 44 bites into the base 5 of the rod 4 when the latter is forced against the projection 18 of the cutting punch 11 at the end of each backward stroke of the ram 15. Thus in addition to the beveled surface 20 corresponding to the chamfering surface 21, a beveled surface 45 corresponding to the auxiliary chamfering surface 43 is formed on the base 5 of the rod 4. The beveled surface 45 is disposed below the beveled surface 20 by the distance h equal to the thickness of one coupling element 2' and hence facilitates the formation of the beveled surface 20 on the next backward stroke of the ram 15.

It will be understood that various changes in the details, material, and arrangements of parts, which have been herein described and illustrated in order to explain the nature of the invention, may be made by those skilled in the art within the principles and scope of the invention as expressed in the appended claims.

What is claimed is:

1. A method of manufacturing coupling elements for a slide fastener, comprising the steps of:

(a) providing a rod of metal of a generally Y-shaped cross section having a base, as a prospective coupling head, and a pair of legs divergently extending from the base;

(b) feeding the rod stepwise in a longitudinal direction;

(c) transversely slicing the rod into a plurality of coupling element blanks in timed relation to said stepwise feeding;

(d) placing the coupling element blanks, one at a time, in a coupling-head forming station remote from the rod in a direction perpendicular to said longitudinal direction;

(e) forming a chamfered portion on the base of the rod each time each coupling element blank is sliced off from the rod and then placed in said coupling-head forming station, each coupling element blank thus having a chamfered base; and (f) at said coupling-head forming station, forming the base of each coupling element blank into a final coupling head of one coupling element which head has a projection from one face and a coacting socket in the other face at such a position that the chamfered portion is disposed around the socket.

2. A method according to claim 1, said slicing step and said placing step and said chamfered-portion forming step being performed in sequence on one stroke of relative movement of a coacting cutting die and punch.

3. A method according to claim 2, said chamfered-portion forming step being performed at one end of each said one stroke of the cutting die and punch.

4. A method according to claim 1, said chamfered portion forming being effected by cold pressing.

5. An apparatus for manufacturing coupling elements for a slide fastener from a rod of metal of a generally Y-shaped cross section having a base, as a prospective coupling head, and a pair of legs divergently extending from the base, said apparatus comprising:

(a) means for feeding the rod in a longitudinal direction in uniform steps of a predetermined distance equal to the thickness of one coupling element;

(b) a fixed cutting punch having a cutting edge and a projection;

(c) a reciprocating ram movable relatively to said cutting punch perpendicularly to said longitudinal direction;

(d) a cutting die carried by said ram and having a hole for the passage of the rod, said cutting die being movable, in response to the reciprocating movement of said ram, across a cutting edge of said cutting punch for transversely slicing the rod into a plurality of coupling element blanks, one on each operating cycle of said ram;

(e) said ram having a channel in which said projection of said cutting punch is slidably received, said channel communicating with said hole at one and thereof;

(f) means, disposed on said projection of said cutting punch, for forming a chamfered portion on the base of the rod at one end of a stroke of said ram, each coupling element blank thus having the chamfered base;

(g) a forming die carried by said ram and movable, in response to the reciprocating movement of said ram, toward and away from said cutting edge of said cutting punch for receiving one coupling element blank at one end of said stroke of said ram; and (h) a forming punch movable toward said forming die for forming the base of each coupling element blank into a final coupling head of one coupling element which head has a projection from one face and a coacting socket in the other face at such a position that the chamfered portion is disposed around the socket.

6. An apparatus according to claim 5, said chamfered-portion forming means including a chamfering surface for being relatively forced against the base of the rod at said one end of said stroke of said ram.

7. An apparatus according to claim 6, said chamfering surface being disposed at a second level below said cutting edge of said cutting punch by a distance equal to n times the thickness of one coupling element, where n represents a natural number.

8. An apparatus according to claim 7, said chamfered-portion forming means further including an auxiliary chamfering surface disposed below said chamfering surface by a distance equal to the thickness of one coupling element.

* * * * *